US005080030A

United States Patent [19]

Taddicken

[11] Patent Number: 5,080,030

[45] Date of Patent: Jan. 14, 1992

[54] DEVICE FOR FORMING AND SEWING FOLDS

[75] Inventor: Hermann Taddicken, Schwäbisch-Gmund, Fed. Rep. of Germany

[73] Assignee: Eisele Apparate-und Gerätebau GmbH, Schwäbisch-Gmünd, Fed. Rep. of Germany

[21] Appl. No.: 573,029

[22] PCT Filed: Feb. 2, 1989

[86] PCT No.: PCT/EP89/00092

§ 371 Date: Sep. 10, 1990

§ 102(e) Date: Sep. 10, 1990

[87] PCT Pub. No.: WO89/07675

PCT Pub. Date: Aug. 24, 1989

[30] Foreign Application Priority Data

Feb. 12, 1988 [DE] Fed. Rep. of Germany ..... 3804376

[51] Int. Cl.[5] ..... D05B 35/08

[52] U.S. Cl. ..... 112/147; 112/132; 28/34

[58] Field of Search ..... 112/144, 145, 146, 147, 112/134, 135, 132, 133; 223/28, 34

[56] References Cited

U.S. PATENT DOCUMENTS

| | | | |
|---|---|---|---|
| 1,993,799 | 3/1935 | Phillips . | |
| 3,190,512 | 6/1965 | Nathanson | 223/30 |
| 3,511,424 | 5/1970 | Tucci | 223/34 |
| 3,661,103 | 5/1972 | Firestein et al. | 112/134 |
| 3,822,034 | 7/1974 | Lawson | 223/28 |
| 3,824,964 | 7/1974 | Ryan | 223/30 |
| 4,515,097 | 5/1985 | Rovin | 112/134 X |
| 4,573,421 | 3/1986 | Mall et al. | 112/146 |
| 4,599,958 | 7/1986 | Stiers | 112/132 X |

FOREIGN PATENT DOCUMENTS 2629117 9/1977 Fed. Rep. of Germany .

OTHER PUBLICATIONS

Manufacturing Clothier, Jul. 1888, "Workplace Engineering in the Sewing Room".

*Primary Examiner*—Werner H. Schroeder
*Assistant Examiner*—Paul C. Lewis
*Attorney, Agent, or Firm*—McGlew & Tuttle

[57] ABSTRACT

Device for forming and sewing folds is provided in which one double fold DF and a plurality of single folds SF, located at spaced locations therefrom, are formed simultaneously on a cut, and the folds are also to be laid out flat with the folding tools.

Three pairs of strips are provided as the holders for the folding tools, and the first of these pairs has two hinge-connected strips 86 and 87, which can be moved between the extended position and a buckled position. The strips of the second and third pairs can be moved in opposite directions and in opposite directions to the strips of the respective other pair, wherein the strips 88/89 and 90/91 of the second and third pairs of strips carry at least one folding knife. The first pair of strips carries the corresponding holders 112. The relative position of the first pair of strips 86/87 relative to the other two pairs of strips 88/89 and 90/91 is variable. The device is intended for producing workpieces with a plurality of folds of varying shapes, e.g., the back part of blouses and shirts.

8 Claims, 5 Drawing Sheets

DEVICE FOR FORMING AND SEWING FOLDS

FIELD OF THE INVENTION

The present invention pertains to a device for forming and sewing folds on fabric cuts with folding tools. The folding tools being formed by two holders arranged at space locations from each other for receiving the cuts a folding knife that can be moved between the holders, and conveying means for grasping and moving the holding cuts past a stitch formation site in a sewing station.

BACKGROUND OF THE INVENTION

A device of this class has been known from West German Patent No. DE-PS 24,28,598. In this prior-art device, a folding chute consisting of two bars, is used for forming folds. The bars are parallel to one another and one end of them projects freely in the direction of the sewing direction. A loop is laid around the two bars and is tucked and is pulled into the folding chute to form a double fold. The loop can be pulled into the folding chute to varying depths, so that the depth of fold can be varied. The bars can be designed as thin but stable wires or thin, narrow, strip-shaped spatulas. These bars are arranged, together with a stop that determines the width of the loop and the workpiece clamp transporting the double fold to a sewing machine for edge sewing by the stitch formation site, on a carriage that is movable relative to the needle. In addition, the bars can be removed from the area of the workpiece in order to facilitate insertion and removal of the workpiece. The prior-art device only makes it possible to form a heart-shaped double fold, which is not laid out flat, from a single tucked loop.

A device for forming a plurality of folds simultaneously has been known from West German Offenlegungsschrift No. 34,05,721. This device is designed as a workpiece clamping holder for sewing devices for sewing the edge zones of lining material and top fabric in the tip corner zone and side corner zones of a necktie. This device is equipped with three clamping plates hinged to each other in order to receive the lining material and the top fabric in a clamping manner in conjunction with a tensioning device between the clamping plates, wherein the side of the middle plate facing the top fabric is designed with a central folding knife and lateral webs for forming a middle fold and two side folds to receive an extra width of top fabric. On the upper plate clamping the top fabric, the workpiece clamping holder is provided with folding slides for folding over and holding down the side folds formed at the side corners. This, together with the clamping plates, clamps the fabrics to be sewn together in the edge zones.

Folding edges are provided on holders connected elastically to the upper clamping plate. During the lowering of the upper clamping plate following the formation of the middle fold, the folding edges come into contact with the top fabric on both sides of the webs. Furthermore, the folding edges provided between the tip corner zone and the side corner zones are designed such that the upper clamping plate following formation of the middle fold prior to deposition of the other folding edges. Because the folding processes take place one after another, it is achieved that the fabric or the extra width of material is pulled in to the folds from defined areas in the fabric cut. Additional, pneumatically operated pushers are provided to lay the side folds flat after they have been formed.

This prior-art device is intended only for forming single folds on workpieces of uniform size, in which the folds are always formed in the same area.

Finally, West German Patent No. 26,29,117 should be mentioned in connection with the technological background of the present invention. That patent discloses a folding device which is arranged in the area of the stitch formation site of a sewing machine and has a plurality of folding plates arranged at spaced locations from each other. The folding plates cooperate in pairs with a fork-shaped folding slide each, for forming a multiple fold each. A plurality of the folding plated are formed one after another, e.g., at the edge of curtains, wherein the fork-shaped folding slides are displaced in opposite directions. Each multiple fold consists of two single folds arranged in a mirror-inverted pattern and at laterally spaced locations, and the single folds are covered by a common middle fold. The multiple fold is fixed in this folded state by needles which are movable in height and are pulled out of the multiple fold after a pressing belt, transporting the zone of the multiple fold through the sewing station, has been lowered onto the multiple fold.

Since the two single fold pairs are formed simultaneously and the fabric length needed for fold formation can be pulled in only from one side of a multiple fold already sewn, the great number of deflecting edges on the folding plates and the folding slides leads to a relatively high friction resistance This friction resistance causes considerable stress not only for the material to be folded and the folding tools, but for the driving device for the folding tools as well. This must be taken into account by designing the folding tools and the driving device as a function of these stresses, and it makes the entire folding device more expensive.

SUMMARY AND OBJECTS OF THE INVENTION

It is an object of the present invention to design a device for forming and sewing folds on fabric cuts with folding tools. The folding tools being formed by two holders arranged at space locations from each other for receiving the cuts and including a for grasping and moving the holding cuts past the stitch formation site in a sewing station, such that a double fold and a plurality of single folds can be formed simultaneously on a workpiece and these can also be laid out flat with the folding tools.

According to the invention, a device for forming folds and sewing folds of fabric cuts is provided including three pairs of strips arranged one on top of another, the strips being provided as holders for folding tools. The first pair of strips includes strips that are connected in a hinge-like manner and may be moved between an extended position in a first height position, via a buckled position forming arrangement and an extended position in a second height position. The second and the third pairs of strips carry at least one folding knife each and the strips of the first pair of strips carry corresponding holding pairs while the strips of the second and third pairs of strips are moveable in opposite directions to each other and relative to the strips of the first pair. The folding knives of the second pair of strips with the holder pairs of the first pair of strips cooperate to form a double fold which includes two single folds which are laid flat in the direction of each other in a middle part of the fabric cuts. The folding knives of the third pair of strips are arranged at space locations laterally from the folding tools of the double fold with the corresponding holder pairs of the first pair of strips serving to form single folds. The single folds are laid flat opposite to each other such that a distance between the first pair of strips and the other two pairs of strips can be changed by the depth of the fold.

The advantage of the present invention is that it is possible, in a relatively simple manner, to form folds of different shapes and to bring them into a position required for fixation by sewing. It is possible to first form a double fold in the middle of the workpiece, e.g., the back part of a blouse or shirt, by folding in the hinge-connected strips of the first pair of strips, at which time the fabric can be pulled in easily and unhindered from the outer sides through the outer folding tools that are not yet closed. After the formation of a double fold, the single folds can be produced laterally from the middle double fold by transferring the hinge-connected strips into an extended position, and, finally, to spread out flat all the folds together in a position suitable for sewing by having the strips in all pairs of strips perform corresponding relative movements It is possible to process workpieces of relatively great length, because the fabric length needed in the folds can be pulled in from the outside without having to overcome any appreciable friction resistance. This is due to the enveloping angle of the fabric around the outer folding tools being still very small during the formation of the middle double fold due to the lower pair of strips being transferred into the buckled position.

For folding and laying the folds out flat, it is advantageous to select the height positions in which the first pair of strips is in the extended position. This second height position of the first pair of strips is such that the carried holding pairs are located below the first height position. Such that the first and third pairs of strips have, on a long side facing a pressing belt of the conveying means, which pressing belt can be lowered onto the fabric to be folded, a plurality of vertical grooves. The vertical grooves provide the beginning of the transfers hole for inserting essentially Z-shaped folding tools (a holder and folding knives) whose connecting web can be received in the grooves between the horizontal legs and whose leg projects from the strips and acts on the fabric to be folded.

The design embodiment of the strips of the first and third pairs of strips for holding the folding tools and the design of the folding tools. This feature makes it possible to insert the folding tools in different locations and to add additional folding tools to change the distance between and the number of the folds.

The measure according to the invention including the provision of the strips of the first pair of strips and the third pair of strips with folding tools arranged on the strips partially covered by guard plates with U-shaped cross section, is taken to secure the positions of the folding tools.

The arrangement of the hinge-connected strips on a separate holder via connecting rods, each to a holding rail that is moveable relative to the other pairs of strips, represents a particularly simple solution for rendering the strips movable between the extended position and a buckled position and relative to the other pairs of strips. The connecting rods compensate for the distance between the hinge points, which change during pivoting around the hinge axis. The possibilities of movement of the strips are increased by their ability to move jointly in height due to the arrangement of all pairs of strips according to the provision that the strips are arranged on holders which are moveable in height relative to the support surface for the fabric to be folded.

To secure the mutual positions of the second and third pairs of strips, these are designed having a lower guide groove for a guide web on the strips of the second pair of strips To facilitate the introduction and removal of the material to be folded, the carriage with the pairs of strips carrying the folding tools is movable together with a carriage at right angles to the sewing direction between a resting position and a feed position.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
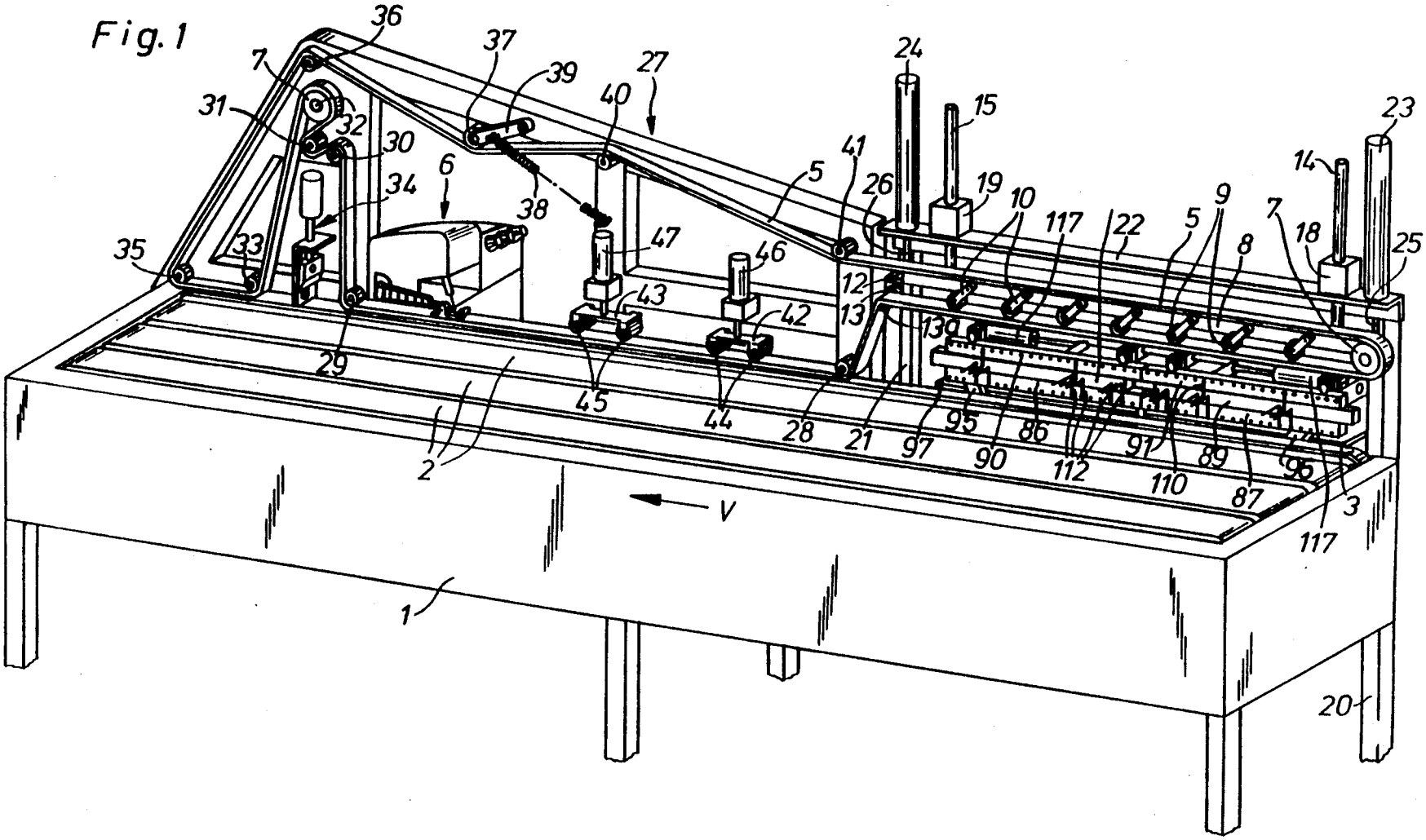
FIG. 1 is a synoptic schematic diagram of a processing plant consisting of a folding station, a transport means, and a sewing station.
Figure 8:
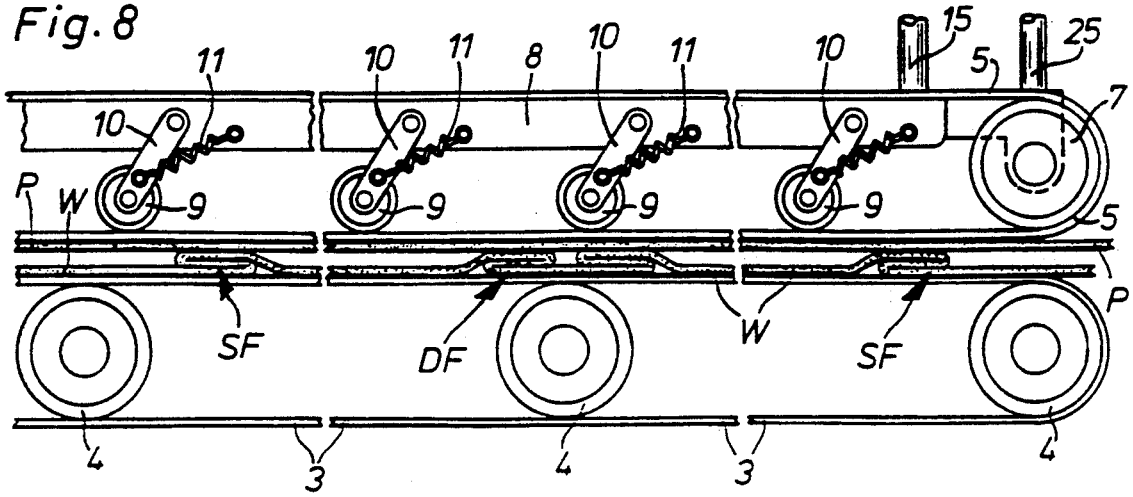
FIG. 8 is a side view showing part of the conveying means with the workpiece taken over whose folded edge was covered with a yoke after removal of the folding tools at the end of the folding process.

The overall plant is arranged on a frame 1, in which a plurality of broad endless conveyor belts 2 and a narrow endless conveyor belt 3 are guided on rotatably mounted rollers 4 (FIG. 8). An upper, endless conveyor belt 5 is provided for moving the workpiece W past the stitch formation site of a sewing machine 6 (FIG. 1). This belt 5 is driven synchronously with the lower conveyor belts 2, 3 and cooperates with the narrow conveyor belt 3. The conveyor belt 5 is led around a deflecting roller 7 (FIG. 1 and FIG. 8) on one side of the frame 1, and the deflecting roller 7 is mounted rotatably on a support rail 8. To press the workpiece onto the lower conveyor belt 3, the lower strand of the conveyor belt 5 is under the effect of pressing rollers 9 on levers 10 which are mounted pivotably at spaced locations on the support rail 8 and are pre-tensioned by a tension spring 11 each against the lower strand of the conveyor belt 5.

An angle 12 is arranged at the left end of the support rail 8 as viewed in FIG. 1, and a pneumatic cylinder 13, whose piston rod 13*a* is movable under the lower strand of the conveyor belt 5, is fastened to the angle 12.

Figure 2:
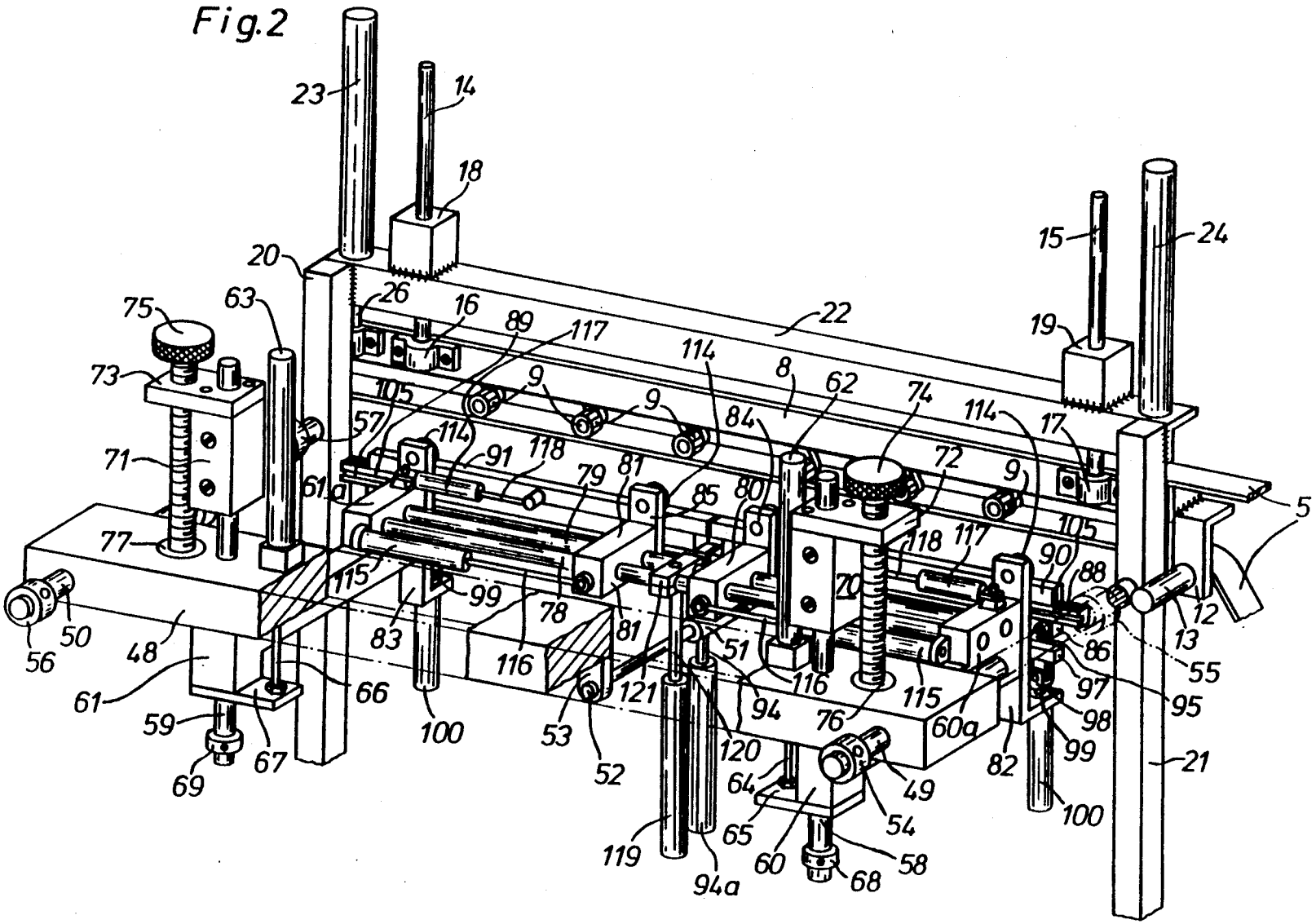
FIG. 2 is a schematic representation of the folding station viewed from the rear side.

Furthermore, two vertical sliding rods 14 and 15 with one clamp strap 16 and 17 (FIG. 2) each, are fastened to the support rail 8, and the vertical sliding rods 14 and 15 are led through a hole in two guide blocks 18 and 19 on a cross strut rigidly connected to the frame posts 20 and 21. Two pneumatic cylinders 23 and 24, whose piston rods 25 and 26, respectively are fastened to the support rail 8, are also fastened to the cross strut 22. The pneumatic cylinders 23 and 24 serve to raise and lower the area of the conveyor belt 5 located above the folding station to the right of the piston rod 13*a* of the pneumatic cylinder 13 in FIG. 1.

The lower strand of the upper conveyor belt 5, which comes into contact with the workpiece, is guided to the sewing machine 6 around a roller 28 mounted rotatably on a frame structure 27 of the frame 1 provided for arranging guide rollers. The lower strand of belt 5 extends upward around a roller 29 mounted behind the stitch formation site of the sewing machine 6, again downward around other rollers 30 through 33 around a pneumatically operated chain separator 34 for engaging again with the workpiece W behind the chain separator 34. Belt 5 extends from there obliquely upward as an upper strand around a roller 35 and around another roller 36 back to the right side as viewed in FIG. 1, under a tensioning roller 37 rotated pivotably on a lever 39 that is mounted pivotably on the frame structure 27 and is tensioned by a tension spring 38, around a roller 40, and under a roller 41 to a deflecting roller 7.

Two pressing roller pairs 44 and 45 mounted pivotably on bearing blocks 42 and 43, respectively between the deflecting rollers 28 and 29 are provided for the lower strand of the conveyor belt 5, and they can be raised and lowered by means of pneumatic cylinders 46 and 47, respectively.

To mount the folding tools, their holders and driving devices, a carriage 48 is provided, which can be displaced on two sliding rods 49 and 50 fastened on the frame posts 20 and 21 at right angles to the direction of feed and sewing arrow V in FIG. 1 by means of a pneumatic cylinder 51 fastened on the frame 1, whose piston rod 52 engages with a web 53 of the carriage 48. Two adjusting rings 54 and 55 as well as 56 and 57 for limiting the displacement of the carriage 48 are fastened on each sliding rod 49 and 50.

One vertical sliding rod 58 and 59 are each passed through holes in the carriage 48 in the vicinity of the side ends of the carriage 48. A holder 60 and 61 each project toward the conveyor belts 2, 3, and 5, mounted displaceably by means of its own pneumatic cylinders 62 and 63 mounted in the carriage 48, is arranged on each sliding rod 58 and 59. The piston rod 64 of the pneumatic cylinder 62 is connected to a shoulder 65 of the holder 60, and the piston rod 66 of the pneumatic cylinder 63 is connected to a shoulder of the holder 61. To limit the upwardly directed displacement of the holders 60 and 61, an adjusting ring 68 is fastened on the sliding rod 58, and an adjusting ring 69 is fastened on the sliding rod 59.

A carrier block 70 and 71, respectively is fastened with a flat bar 72 and 73, respectively fastened with screws on the top side on the end of each sliding rod 58 and 59 projecting upwardly from the carriage 48, and the flat bar projects over one side of said carrier blocks 70 and 71. A setscrew each 74 and 75 is screwed into the free end of each flat bar 72 and 73, which end is provided with a tapped hole, for adjusting the height of the sliding rods 58 and 59, and the lower end of the setscrew (not shown) is designed as a pin and extends into a support bearing 76, 77 in the carriage 48.

The broadened front ends 60*a* and 61*a* of the holders 60 and 61, respectively, which are adjacent to the conveyor belts 2, 3; and 5 are connected by two horizontally directed bars 78 and 79 arranged at spaced locations from each other, on which two sliding blocks 80 and 81 are slidably mounted. An angle bracket 82 is screwed onto the front end side of the end 60*a*, an angle bracket 83 is screwed onto the front end side of the end 61*a*, a flat iron 84 is screwed onto the front side of the sliding block 80 adjacent to the conveyor belts 2, 3, and 5, and a flat iron 85 is screwed onto the front end side of the slide block 81.

Three pairs of strips, which are arranged one on top of another and consist of strips 86 and 87; 88 and 89; and 90 and 91 of approximately rectangular cross section, are used as holders for the folding tools of the device. The first pair of strips 86 and 87 are connected in the middle by a pin 92 in a hinge-like manner, and the piston rod 94 of a pneumatic cylinder 94*a* fastened on the frame 1, where the end of the piston rod is provided with a receiving head 93 for the pin 92, acts on the bolt. The outer end of said strips 86 and 87 are connected by a connecting rod each 95 and 96, respectively to a holding rail 97. The piston rod 99 of each pneumatic cylinder 100 acts on the outer ends of the holding rail 97 via a fork head 98. The pneumatic cylinders 100 are arranged on the angles 82 and 83, respectively.

Figure 10:
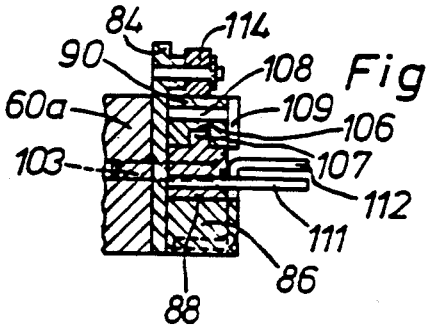
FIG. 10 is a sectional view taken along line X—X in FIG. 3.
Figure 11:
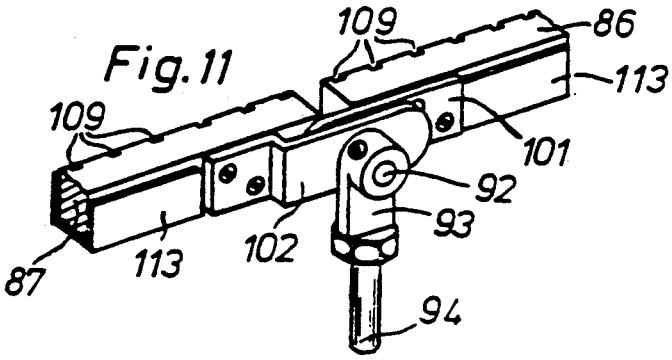
FIG. 11 is a schematic view of the hinged connection of the first pair of strips.

As is apparent from FIG. 11, a plate 101 provided with a hole for passing through the hinge pin 92 is fastened on the strip 86, and a bent pate 102, which also has a hole for passing through the hinge pin 92, is fastened to the strip 87. The strip 88 is fastened to the flat iron 84 and to the sliding block 80 by a plurality of screws 103 (FIG. 10) in the vicinity of one end and to the flat iron 85 and the sliding block 81 by screws 103.

A horizontal guide web 104 (FIG. 9) for a groove 105 is provided in the strips 88 and 89 for support on the vertical leg of the angle brackets 82 and 83.

Figure 9:
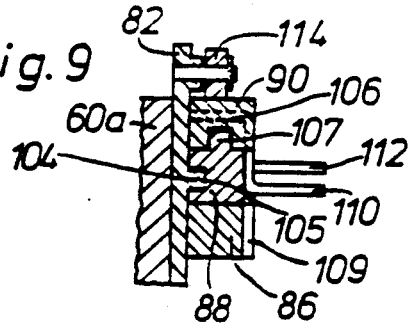
FIG. 9 is a sectional view taken along line IX—IX in FIG. 3.

The strips 90 and 91 of the third pair of strips have a groove 106 as shown in FIG. 9 on the lower side. A guide web 107 is provided on the strips engages the groove 106.

On the side adjacent to the conveyor belts 2, 3, and 5, a plurality of horizontal holes 108 and an equal number of vertical grooves 109 corresponding to the diameter of the holes are provided in the strips 86 and 87 of the first pair of strips and in the strips 90 and 91 of the third pair of strips. Approximately Z-shaped folding tools 110 and 112 as well as two straight folding bars 111 are provided for folding folds by twofold angular bending. The desired number of the folding tools 110 is inserted with one horizontal leg into a hole 108 of the strips 90 and 91 of the third pair of strips at the desired distance from the side folds SF to be folded. The middle part is held nonrotatably in a vertical groove 109, and the horizontal leg of the folding tools 110 that projects from the strips 90 and 91 serves as a folding knife. The straight folding bars 111, fitted into the holes at the opposite ends of the strips 88 and 89, also serve as a folding knife during the formation of the middle double fold DF.

Two each of the Z-shaped folding tools 112 are provided for cooperating with each folding knife 110 and 111, and these folding tools are also inserted with one horizontal leg into a hole 108 and, for protection against rotation with the middle part, into a vertical groove 109 of the strips 86 and 87 of the first pair of strips, while their other horizontal leg projects from the strips 86 and 87 and serves as a holder for the fabric.

To secure the folding tools 110 and 112 inserted into the holes 108 and the grooves 109 against unintended pulling out, U-shaped plates 113 are provided. One each of the U-shaped plated 113 is pushed over the strips 90 and 91 from the top over the middle part of the folding tools 110 and into the carriage 109 and to the strips 86 and 87 from the bottom over the middle part of the folding tools 112 and into the carriage 109.

To hold the strips 88 through 91 in their mutual positions during their relative displacement, one stop roller 114 each is mounted rotatably on the angle brackets 82 and 83 and the flat irons 84 and 85.

Two pneumatic cylinders 115 are provided to mutually displace the strips 88 and 89 of the second pair of strips. The end of the housing of one of the pneumatic cylinders 115 is fastened to the holder 60, and the other end of the housing of the other pneumatic cylinder 115 is fastened to the holder 61. The piston rod 116 of one of the pneumatic cylinders 115 acts on the sliding block 80, to which the strip 88 is fastened, and the piston rod 116 of the other pneumatic cylinder 115 acts on the sliding block 81, to which the strip 89 is fastened.

Two pneumatic cylinders 117 are provided for mutually displacing the strips 90 and 91 of the third pair of strips. The end of the housing of one of the pneumatic cylinders is fastened to the front end 60*a* of the holder 60, and the end of the housing of the other pneumatic cylinder 117 is fastened to the front end 61*a* of the holder 61. The piston rod 118 of one of the pneumatic cylinders 117 acts on the strip 90, and the piston rod 118 of the other pneumatic cylinder 117 acts on the strip 91.

To support the holders 60 and 61 with the three pairs of strips, a pneumatic cylinder 119, (see FIG. 2) arranged on the frame 1 is provided, whose piston rod 120 is connected to the bars 78 and 79 via a clamping block 121 tensioned with the bars 78 and 79.

MODE OF OPERATION

It is assumed that when the plant is out of operation, the part of the conveyor belt 5 located in the zone of the folding station is raised by the piston rods 25 and 26 of the pneumatic cylinders 23 and 24, respectively. The piston rods 25, 26 acts on the support rail 8, and the piston rod 13*a* of the pneumatic cylinder 13 extend under the lower strand of the conveyor belt 5. The three pairs of strips 86/87, 88/89, and 90/91 assume the feeding position shown in FIGS. 1, 2, and 3, in which the folding tools 110, serving as folding knives and inserted into the holders 108 and 109 of the strips 90 and 91 of the third pair of strips, and the folding bars 111, in the strips 88 and 89 of the second pair of strips, are located between two folding tools 112 The folding tools 112 are inserted at spaced locations in the holders 108 and 109 of the strips 86 and 87 of the first pair of strips and serve as deflecting bars for the fabric and as an abutment for the respective folding knife 110 and 111 and are located under their horizontally projecting legs, as is apparent especially from FIGS. 3, 9, and 10.

Figure 3:
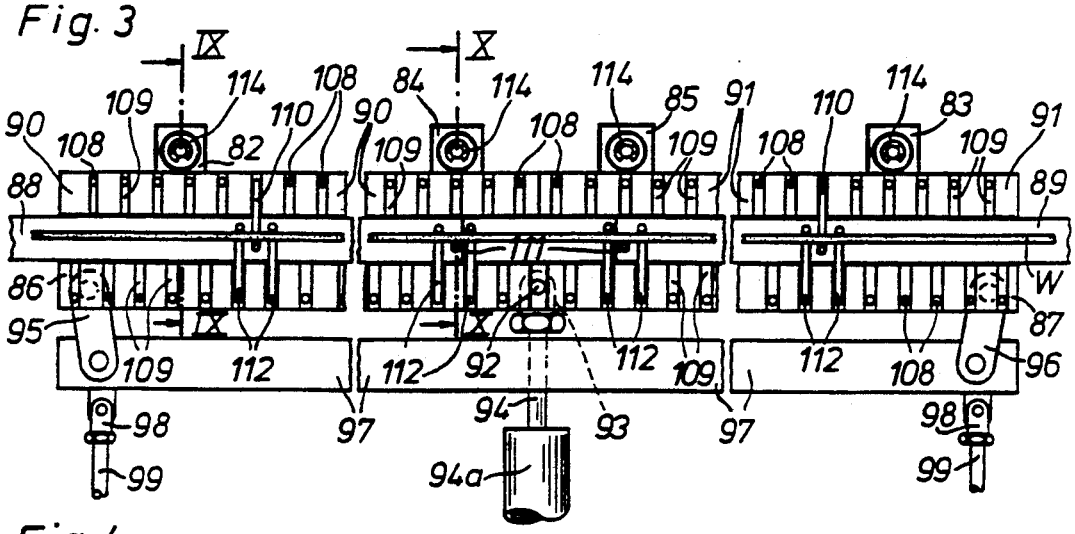
FIGS. 3–7 are schematic representations showing the pairs of strips with the folding tools and the workpiece introduced during selected phases of work to illustrate the mode of operation of the device, wherein the guard plates for the folding tools in FIG. 3 are omitted.
Figure 4:
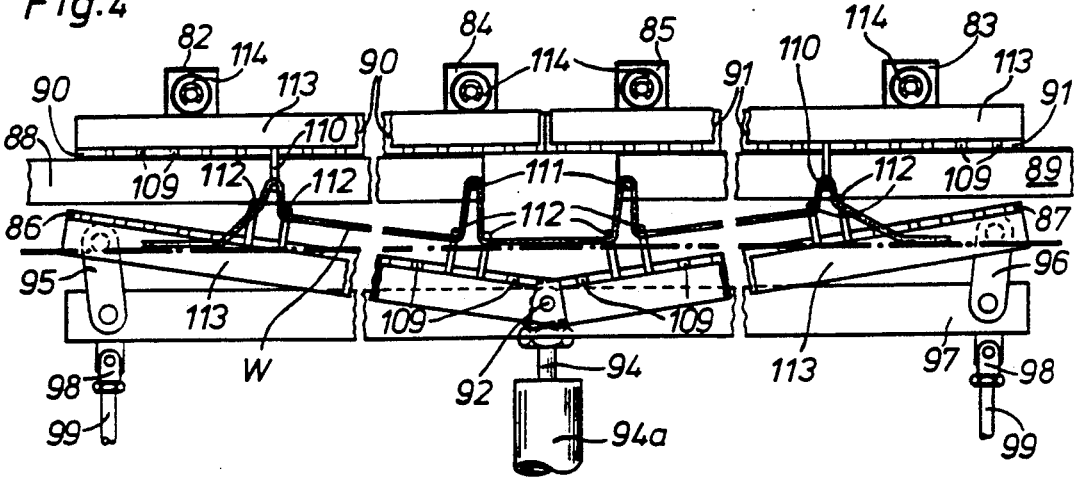

A workpiece W is then introduced between both the projecting legs of the folding tools 110 and 111 and the projecting legs of the folding tools 112 as is apparent from FIG. 3. The hinge-connected pair of strips 86 and 87 is subsequently moved by the piston rod 94 of the pneumatic cylinder 94*a* from the extended position shown in FIG. 3 into a buckled position shown in FIG. 4. The folding knives 110 and 111 and the holders 112 now perform a relative movement, so that the two middle folds of the double folds DF are made deeper than the side folds SF. The length of fabric needed for fold formation is thus pulled in from the outer sides without hindrance, because the workpiece W surrounds the outer folding tools 110 and 112 through a smaller enveloping angle, i.e., the friction is much lower than if all folds were made simultaneously to the same depth. The procedure according to the object of the present invention makes it possible to process longer or larger workpieces containing a plurality of folds.

Figure 5:
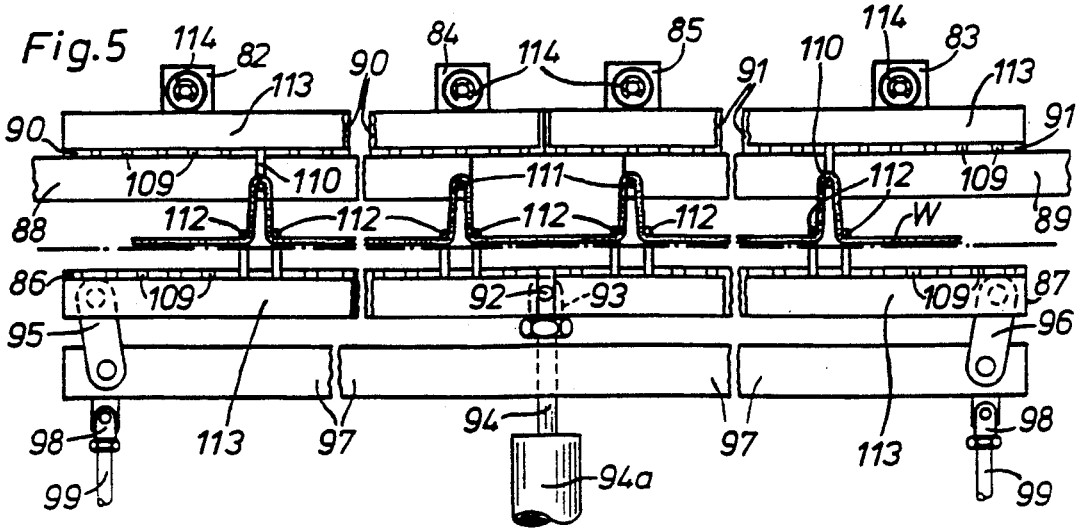

To pull all folds completely to the desired fold depth, the first pair of strips 86 and 87 is then brought into the extended position according to FIG. 5 by appropriately operating the pneumatic cylinders 94*a* and 100 with compressed air. The second and third pairs of strips 88/89 and 90/91 are subsequently moved in the downward direction by appropriately operating the pneumatic cylinders 62, 63, and 119 and, at the same time, the first pair of strips 86/87 is moved in the upward direction by means of the pneumatic cylinders 94*a* and 100, so that the projecting horizontal legs of the folding tools 112 maintain their height position relative to the support surface for the workpiece, and the second and third pairs of strips 88/89 and 90/91 are moved toward the first pair of strips 86/87.

Figure 6:
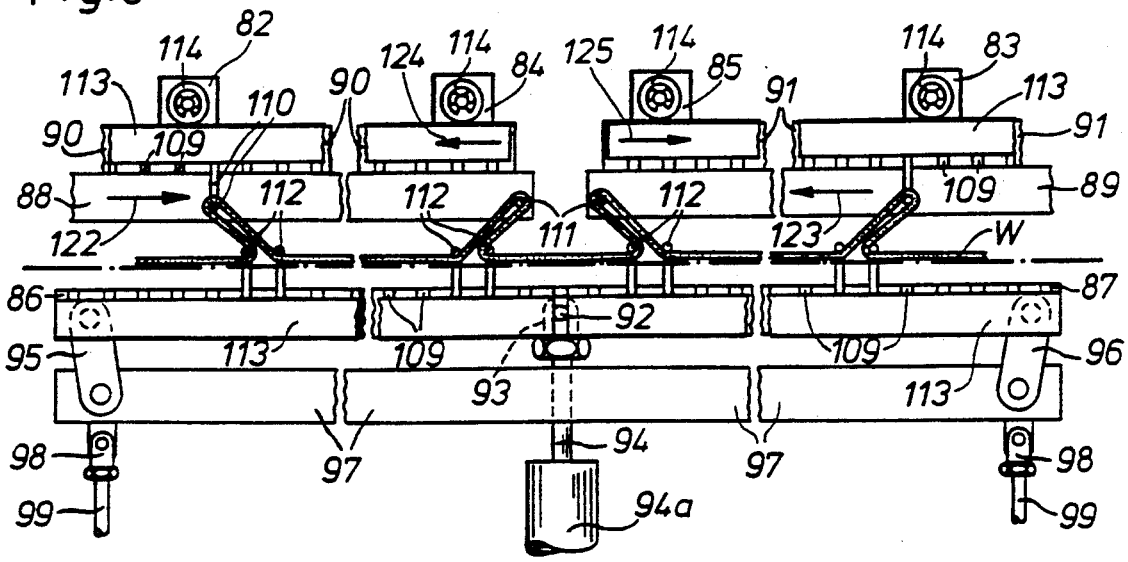

During this movement process, the strips 88 and 89 of the second pair of strips and the strips 90 and 91 of the third pair of strips are moved in opposite directions by the pneumatic cylinders 115 and 117, respectively. The strips 88 and 89 are moved toward each other from the outside and the strips 90 and 91 are moved away from each other from the inside, as is indicated by arrows 122 through 125 in FIG. 6

Figure 7:
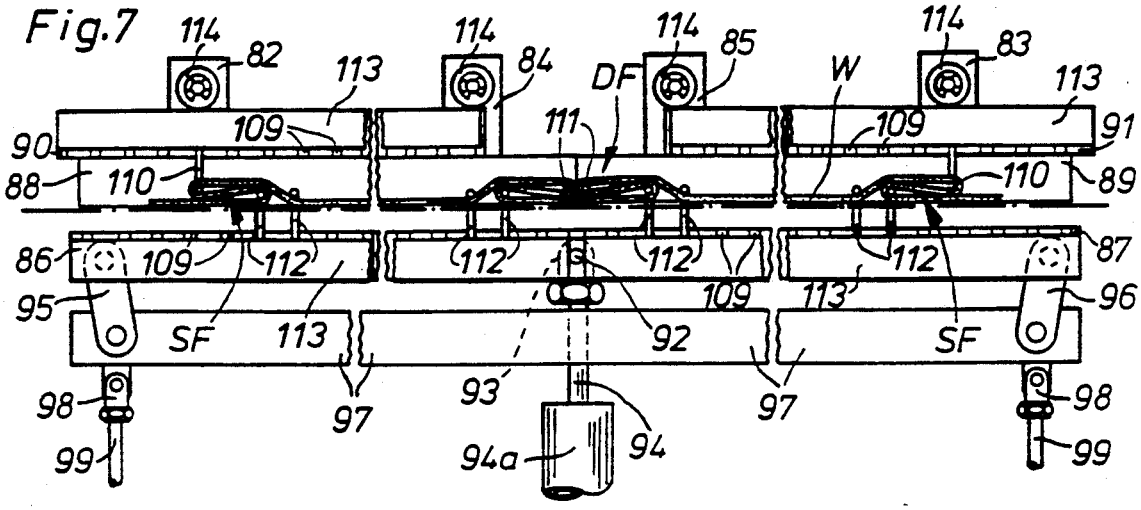

The single folds formed in the vertical direction, which are shown in FIG. 5, are laid flat during the described movement processes of the three pairs of strips 86/87, 88/89, and 90/91 such that the two single folds are rotated toward each other at an angle of 90° in the middle to form a double fold DF, FIG. 7, and the single folds on both sides of the double fold DF are rotated through 90° to the outside to form side folds SF, FIG. 7. The folding process is now complete. A so-called yoke P is then placed over the flattened folds DF and SF, and the support rail 8 with the part of the upper conveyor belt 5 located above the folding station is lowered by operating the pneumatic cylinders 23 and 24, and the piston rod 13*a* of the pneumatic cylinder 13 is retracted. The workpiece W provided with folds DF and SF is pressed, together with the yoke P, onto the lower conveyor belt 3 by the lower strand of the conveyor belt 5 via the pressing rollers 9.

By operating the pneumatic cylinder 51, the carriage 48 with the entire folding device is then displaced on the sliding rods 49 and 50 at right angles to the workpiece feed direction arrow V in FIG. 1 into the starting or resting position defined by the adjusting rings 54 and 56, while the folding tools 110, 111, and 112 are pulled out of the folds DF and SF, and the strips 88 and 89; 90 and 91 of the second and third pairs of strips are also displaced into their starting positions shown in FIG. 3 by operating the pneumatic cylinders 115 and 117.

The conveyor belts 2, 3, and 5 are now switched on, and the workpiece W with the yoke P is fed through the sewing station in the direction of the arrow V in FIG. 1 for sewing the folded workpiece W to the yoke P. Photocells for switching the sewing machine 6 and the chain separator 34 on and off may be arranged along the path of movement, so that the sewing machine 6 and the chain separator 34 are switched on and off, depending on the workpiece. The conveyor belts and the sewing machine can also be switched off, depending on the workpiece.

As soon as the end edge of the material to be sewn has passed over the roller 28 FIG. 1, the part of the upper conveyor belt 5 located above the folding station can be raised by the piston rods 25 and 26 of the pneumatic cylinders 23 and 24, respectively, which [piston rods] are connected to the support rail 8 into the position shown in FIG. 1, and the folding device with the frame 48 can be displaced by the pneumatic cylinder 51 on the sliding rods 49 and 50 at right angles to the direction of feed arrow V in FIG. 1 into the loading position of the folding tools 110, 111, and 112 along the three pairs of strips 86/87, 88/89, and 90/91, so that the next workpiece W can be introduced between the folding knives 110 and 111, on one hand, and the holder 112, on the other hand, and the above-described process can be started again.

While a specific embodiment of the invention has been shown and described in detail to illustrate the application of the principles of the invention, it will be understood that the invention may be embodied otherwise without departing from such principles.

I claim:

1. A device for forming folds and sewing folds on fabric cuts, comprising: a sewing station including a stitch formation site; a conveying means for conveying folded articles to the stitch formation site; and a folding arrangement means having three pairs of strips arranged one on top of another acting as holders for folding tools, including a first pair of strips having a hinge-like connection for movement between an extended position and a buckled position, strips of a second and third pair of strips each carrying at least one folding knife, strips of said first pair of strips carrying corresponding holding element pairs, said strips of said second and third pair of strips being moveable in opposite directions relative to each other and relative to the strips of said first pair of strips, each said folding knife of said second pair of strips and said holding element pairs of said first pair of strips cooperating to form a double fold including two single folds that are laid flat each extending in a direction toward the other in a middle part of the fabric and each said folding knife of said third pair of strips being arranged at a spaced, location later, from each said knife of said second pair and said holding element pairs of the first pair of strips, each said folding knife of said third pair of strips cooperating with additional holder pairs of said first pair of strips to form single folds, said single folds being laid flat opposite to each other, wherein a distance between the first pair of strips and the second and third pair of strips can be changed in dependence upon the depth of the fold to be produced.

2. A device according to claim 1, wherein a second height position of the first pair of strips, carrying the holding pairs, is located below a first height position corresponding to said extended position.

3. A device according to claim 1, wherein said conveying means includes a pressing belt which can be lowered on to the fabric to be folded, each of said first and third pairs of strips having, on an elongated side facing said pressing belt, a plurality of vertical grooves, each of said vertical grooves cooperating to form a transverse hold for inserting essentially Z-shaped folding tools, including a holder of said holding element pairs and/or one said folding knife, said folding tools include a connecting web which may be received in one of said grooves between a horizontal leg and said tools including a leg projecting from said strips for acting on the fabric to be folded.

4. A device according to claim 3, wherein said strips of said first pair of strips and said strips of said third pair of strips, including said folding tools, are arranged partially covered by guard plates with U-shaped cross section.

5. A device according to claim 1, wherein free ends of said strips of said first pair of strips are each connected by a connecting rod to a holding rail, said holding rail being moveable relative to said second and third pairs of strips.

6. A device according to claim 1, wherein each of said first, second and third pairs of strips are arranged on holders, said holders being moveable in height, relative to a support surface for the fabric to be folded.

7. A device according to claim 1, wherein said first pair of strips each have a lower guide groove for a guide web on the strips of the second pair of strips.

8. A device according to claim 1, wherein each of said first, second and third pairs of strips are moveable, together with a carriage arrangement, at right angles to a sewing direction between a resting position and a feed position.

* * * * *